US005158209A

United States Patent [19]

Reil et al.

[11] Patent Number: 5,158,209

[45] Date of Patent: Oct. 27, 1992

[54] IMPROVED CONSTRUCTION OF MOLDED PLASTIC CONTAINERS

[75] Inventors: Wilhelm Reil, Bensheim; Ulrich Deutschbein, Muhltal; Gerd Knobloch, Griesheim; Udo Liebram, Pfungstadt, all of Fed. Rep. of Germany

[73] Assignee: Tetra Pak Holdings & Finance S.A., Pully, Fed. Rep. of Germany

[21] Appl. No.: 614,286

[22] Filed: Nov. 16, 1990

[30] Foreign Application Priority Data

Nov. 24, 1989 [DE] Fed. Rep. of Germany ..... 3938873

[51] Int. Cl.[5] ..... B67D 5/56

[52] U.S. Cl. ..... 222/129; 215/6; 220/4.23; 220/4.24; 222/143

[58] Field of Search ..... 222/94, 129, 143; 493/114, 162, 405; 220/4.23, 4.24, 23.2, 23.8; 215/6

[56] References Cited

U.S. PATENT DOCUMENTS

| | | | |
|---|---|---|---|
| 2,726,004 | 12/1955 | McLeod | 220/23.2 |
| 3,227,319 | 1/1966 | Rosier | 222/94 |

FOREIGN PATENT DOCUMENTS

| | | | |
|---|---|---|---|
| 736314 | 6/1966 | Canada | 220/4.24 |
| 0299124 | 1/1989 | European Pat. Off. . | |
| 3616207 | 11/1987 | Fed. Rep. of Germany | 222/129 |
| 1152024 | 6/1956 | France . | |
| 1145349 | 10/1957 | France | 220/4.24 |
| 928448 | 12/1963 | United Kingdom | 220/4.24 |

OTHER PUBLICATIONS

German Gebrauchmuster, Rheinstahl Henschel Abstiengesellschaft, 1,955,857, Feb. 1967.

German Gebrauchmuster, Louis L. Lepoix, 1,954,849, Feb. 1967.

German Gebrauchmuster, Firma Ambi-Budd Preisswerk, 1,737,766, Dec. 1956.

*Primary Examiner*—Andres Kashnikow
*Assistant Examiner*—Joseph A. Kaufman
*Attorney, Agent, or Firm*—Paul & Paul

[57] ABSTRACT

Described is a package for flowable media and having tube-like side walls (1, 1'), bottom and top walls (6, 6') and a closable pourer (7); all parts of the pacakage consists of synthetic plastics material. For more competitively priced production, ease of stacking and a reliable sealing-tight and yet easily opened closure, according to the invention two tub-shaped parts (I, II), each forming an entire side wall (3'), two oppositely disposed and adjacent half side wall parts (1'), a half bottom part and a half upper wall part (6') with a half pourer device (7 to 9), are in each case sealed and connected to each other individually by a synthetic plastics film which rests on and projects outwardly beyond the rim (13) in the form of a web (15), and in that the cylindrical edge (8) of the pourer device (7) extends beyond the web (15) of the synthetic plastics film (14) onto both tub-shaped parts (I, II) and in that the thickness of the synthetic plastics film is 0.01 to 0.5 times and preferably substantially 0.1 times the thickness of the tub-shaped parts.

6 Claims, 5 Drawing Sheets

IMPROVED CONSTRUCTION OF MOLDED PLASTIC CONTAINERS

The invention relates to a package for flowable contents having tube-like side walls, bottom and top wall and with a closable pourer device, all parts of the package consisting of synthetic plastics material.

Packages for liquids, e.g. milk packages, of the type described hereinabove are commercially available. They generally require complicated processes and energy in their manufacture if they are to function reliably for the end user. The consumption of synthetic plastics material is often substantial, so that such packages are not readily regarded as disposable articles or articles intended to be used only once. In exceptional cases, when for example solids of the granulate type are to be packaged, relatively simple pourer devices and closure means can be used in order to reduce manufacturing costs and material consumption. But then liquids cannot be contained or packed in the packages, so that the range of applications of such packages is too greatly restricted. Again, other packages have tops or covers which are in particular formed by injection moulding, deep-drawing or other production methods which are known for the processing of synthetic plastics materials and which are conditioned by production requirements and exclude the possibility of satisfactory stacking.

The object of the present invention, therefore, is so as to provide a package for flowable contents and of the aforementioned type that competitively priced manufacture ready stackability, reliably sealing-tight closure and easy opening are all guaranteed.

In order to resolve this problem, it is according to the invention proposed that two tub-shaped parts, each of which forms an entire side wall connected adjacent two fractional side wall parts, connected adjacent a fractional bottom part and connected adjacent a fractional upper wall part with a fractional pouring device, each tub-shaped part being connected to one another as well as being individually sealed by means of a synthetic plastics film applied to and projecting outwardly beyond the rim in the form of a web, and in that the cylindrical edge of the pourer device extends beyond the web of synthetic plastics film to both tub-shaped parts and in that the thickness of the synthetic plastics film is 0.01 to 0.5 times and preferably substantially 0.1 times the thickness of the tub-shaped parts. These measures make it possible to completely resolve the problem; i.e. a processing of suitable synthetic plastics material at acceptably low production costs. Also ready stackability, suitable shaping and a reliably sealing-tight and yet easily opened pourer device can also result.

When reference is made to two parts in the form of a tub (tub-shaped), such also includes the shapes of a beaker, a pot or a pan, the only important point being that what is provided is a vessel or a container with which essential parts of the package are formed. It may indeed be preferred to connect to each other two substantially identically formed tub-shaped parts so that each tub part finally represents about one-half of the package and the dividing line between the two tub-shaped parts can be so shifted that one part represents a third while the other represents two-thirds of the package volume, and so on. For this reason, reference is made to "fractional" side wall parts, bottom parts and the like. Therefore, each tub TM shaped part forms an entire side wall, having adjacent thereto two respectively opposite side wall parts, a bottom part and a top wall part, only one part of the pourer device being formed on the relevant top wall part, for example by deep-drawing or injection moulding and for example half one pourer device on a half top wall part. As in the case of a substantially cross-sectionally rectangular tub, the bottom of this tub constitutes one whole side wall, while the four edges of this tub are formed by bottom part and oppositely disposed top wall part on the one hand and fractional (e.g. half) adjacent side wall part and, opposite this, another fractional side wall part.

A man skilled in the art may well imagine that when bringing two such tub-shaped parts together, it is possible to form a joint space which is then closed on all sides. In this way, joining the two tub-shaped parts together does create a complete package, the fractional side wall parts complementing themselves to form the relevant other side walls: the fractional bottom parts augmenting each other to form the bottom of the package while the fractional top wall parts supplement each other to form the top wall of the package.

From the manufacturing point of view, it is particularly advantageous if, prior to Joining the tub-shaped parts to each other, the said parts are sealed, preferably in a fluid-tight manner, e.g. by welding. In fact, if a deep-drawable synthetic plastics material is used for producing the package, then it has a certain thickness which permits the deep-drawing. On the other hand, it is extremely difficult to weld a relatively thick sheet of synthetic plastics material, because quite a substantial volume of plastics material has to be heated through and through. Therefore, prior art packages which are produced from tub halves can sometimes require an excessive cost for joining together and producing the overall package. According to the invention, surprisingly, the relevant tub-shaped part is individually sealed by a synthetic plastics film in the above-described manner, the film being for example welded onto the edges of the tub-shaped part. The thickness of the synthetic plastics film may be substantially less than that of the tub-shaped part, so that passage of heat through to the rim of the tub-shaped part is possible with minimal expenditure so that manufacture consequently becomes substantially less expensive.

In particular, packages to hold fluids are however, as far as possible, filled while they are being produced, and it has long since seemed impossible to a man skilled in the art first to seal tub-shaped parts with a synthetic plastics film because he believed that afterwards the package would have to be opened again at particular expense for filling, after which it would need to be sealed once again.

However, if in accordance with the teaching of the invention the cylindrical edge of the pourer device is so disposed that it extends beyond the web of synthetic plastics film and onto the two tub-shaped parts, then simple and rapid opening and subsequently reclosing are possible. Therefore, there is on each side of the synthetic plastics film a part of the pourer device which, viewed from one side and in the direction of the main plane of the synthetic plastics film, can be readily opened and then subsequently closed again.

The completed pourer device consists in any case of a cylindrical edge provided, for example, with an external screwthread and which is integrally formed on or is so connected to the top wall that the interior space of the tub-shaped part—and in fact on each side of the synthetic plastics film—can be filled and emptied through this outwardly open cylindrical edge Therefore, the cylindrical edge comprises an outwardly extending pourer orifice and is inwardly connected to the relevant space within the tub-shaped part, without the synthetic plastics film extending between the parts being functionally ruptured. To occlude the pourer orifice, it is possible in a per se known manner to use a screw cap or the like.

According to the invention, it is furthermore expedient if the web of synthetic plastics film which projects beyond the rim of the tub-shaped part can, together with the said rim, be cut off in the region of the pourer device and otherwise doubled over and placed around the surface of the package. Since each tub-shaped part is fluid-tightly sealed by a synthetic plastics film so that a part of the synthetic plastics film projects web-like beyond at least some of the edges of the tub-shaped part, then when the two tub-shaped parts are joined, a doubled rim and film web result but they can without difficulty be folded over around the surface of the package. Thus, the package is not only more readily stacked and more practical but it has an appealing appearance. In the region of the pourer device, the rim and the web of synthetic plastics film laid on it are cut off, for instance so that the entire outer surface of the cylindrical edge is free and has no web so that, for instance, a cap or some other closure member can be applied in sealing-tight manner.

By virtue of the different thicknesses of the materials used for the tub-shaped parts with the pourer device on the one hand and for the synthetic plastics film on the other, all the welding and cutting operations in connection with the synthetic plastics film or the web are free from technical problems.

Manufacture is further simplified in that the rim of the tub-shaped part and the web of synthetic plastics film which projects beyond while resting on it can pass centrally and in a U-shape around the surface of the package from one side wall over the top wall to the opposite side wall so that it ends in each case folded over surface-to-surface on itself at the edge between the side wall and the bottom. It is, for example, expedient to leave the bottom flat and without any such synthetic plastics web, because then manufacture of the two tub-shaped parts in one piece is possible in that both parts are connected to each other in hinging fashion via the relevant bottom part. It is then, for example, sufficient to lay a single joint synthetic plastics film over both tub-shaped parts during manufacture and to weld it to them in sealing-tight manner without its edge (that would be a web of the synthetic plastics film) projecting therefrom in the region of the bottom. In the case of this particularly preferred embodiment, the web of synthetic plastics film and a thicker rim do not therefore encircle the package completely, for example over 360° or around all four sides of the package when this is imagined in section along the plane of the synthetic plastics film, but only in a U-shaped pattern along three sides, where the web forms a U and is disposed to project beyond the edge of each tub-shaped part. The long arms of the U can then be compared with the oppositely disposed side walls while the short web of the U, connecting these long arms, would occur the top wall.

In an advantageous further development of the invention, the pourer device is disposed in a recess and is lower down than the top wall. Although the synthetic plastics material which, of course, with no cardboard or paper, for instance forms the actual wall of the overall package, is deep-drawn or injection moulded, it is possible nevertheless to accommodate the pourer device in the region of the top wall in a recess so that also the farthest projecting cap, a handle, a hinge or the like does not project beyond the overall contours of the package and particularly not beyond the outermost surface of the top wall. Thus, the package can be readily stacked and easily be handled during transfer packing.

The invention is expediently further developed in that the bottom comprises recesses which are increasingly deeper as they extend outwardly towards the edge. Where the completed package is concerned, the outer contours of the bottom are nevertheless flat in order to afford the package a satisfactory surface on which it can stand. This flatness is broken by the aforesaid recesses which may for instance be notch-like depressions. Thus, the stability of the package is in no way impeded. On the other hand, however, the package may be more ruggedly constructed particularly in the preferred embodiment in which the package consists of two substantially equal-size tub-shaped parts which are hinged together in the region of the bottom, as described above, so that in manufacture they can be machined substantially simultaneously and by adopting the same measures.

For favourable handling by the end user, it is expedient if at least two mutually opposite side walls each comprise a gripper recess. This ensures a practical handle which is in the form of a recess which is agreeable to the hand, without the handle projecting beyond the outer contours of the package and representing an obstacle to transfer packing.

Furthermore, it is according to the invention expedient for the synthetic plastics material of the package to be capable of being deep-drawn, and for it preferably to be a thermoplastics material, in particular polypropene. A possible thermoplastics material may be PVC and polypropene is in the industry widely known as polypropylene.

When using such synthetic plastics materials, at least one and preferably both tub-shaped parts can be deep-drawn. Such synthetic plastics materials are processed in the form of films, sheets or webs. The new package then consists of parts which can be perfectly reprocessed (in contrast to composite materials).

In the case of a particularly preferred embodiment, the polypropene can also be filled, suitable fillers being chalk, mica, talcum, gypsum or the like. In practice, degrees of filling of substantially 60% have been found to be favourable. Furthermore, it has been observed that synthetic plastics materials which are filled in this way can be deep-drawn and also sealed.

Further advantages, features and possible applications of the present invention will emerge from the ensuing description of preferred examples of embodiment, in conjunction with the accompanying drawings, in which.

Figure 1:
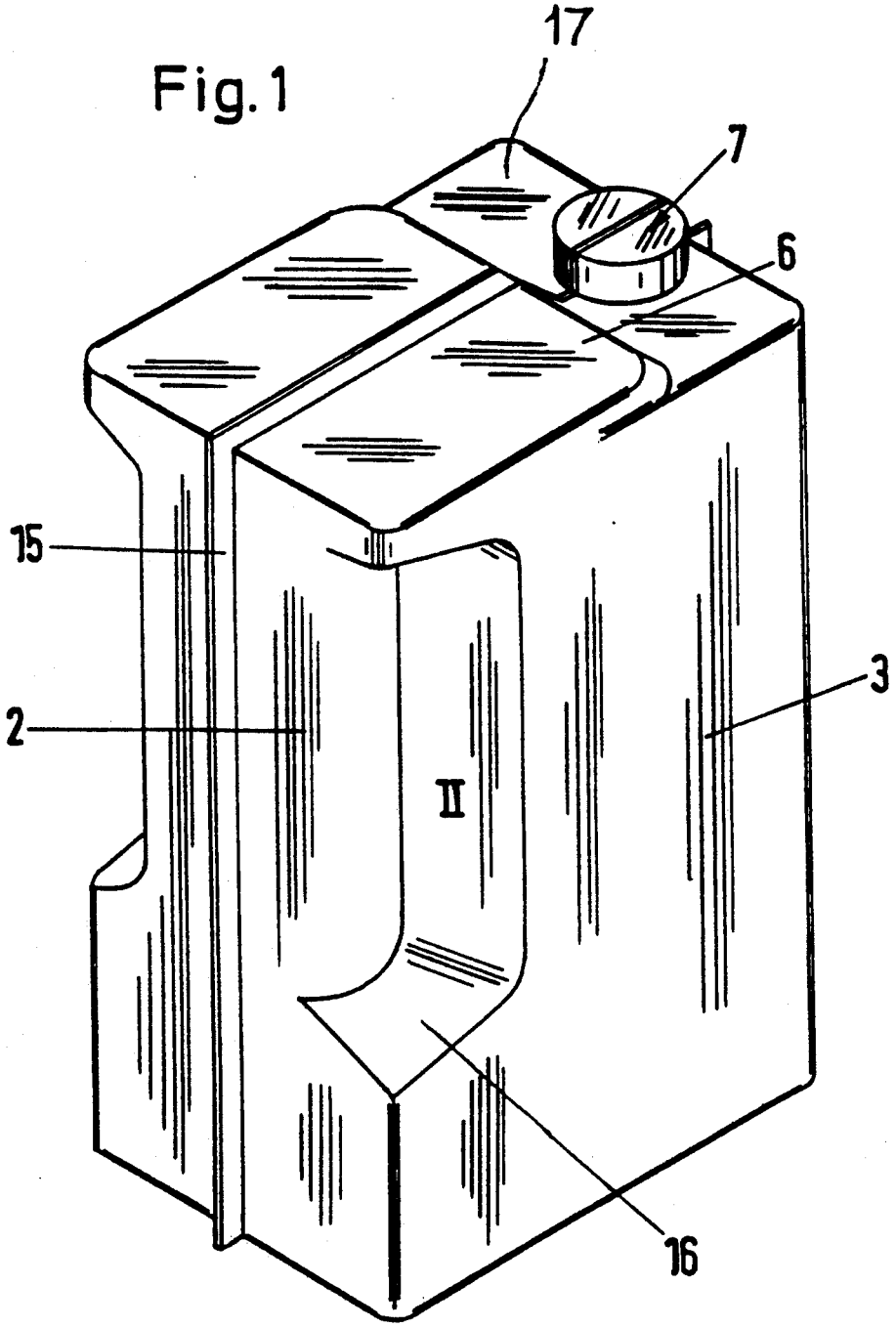
FIG. 1 is a perspective view from the side obliquely from the top and rear, with the pourer device disposed farther forwards.

The package which is to a certain extent incomplete and which is shown in various embodiments in the individual drawings comprises four tube-like side walls, namely the front narrow side wall 1 disposed beneath and alongside the pourer device, and which is composed of the two front half side wall parts 1'; the rear narrow side wall 2, which consists of the rear half side wall parts 2', a large side wall 3 and opposite it a large side wall 4, the bottom 5 which is composed of two half bottom parts 5' and the top wall 6 with the pourer device generally designated 7, the top wall likewise being composed of two half top wall parts 6'.

Figure 7:
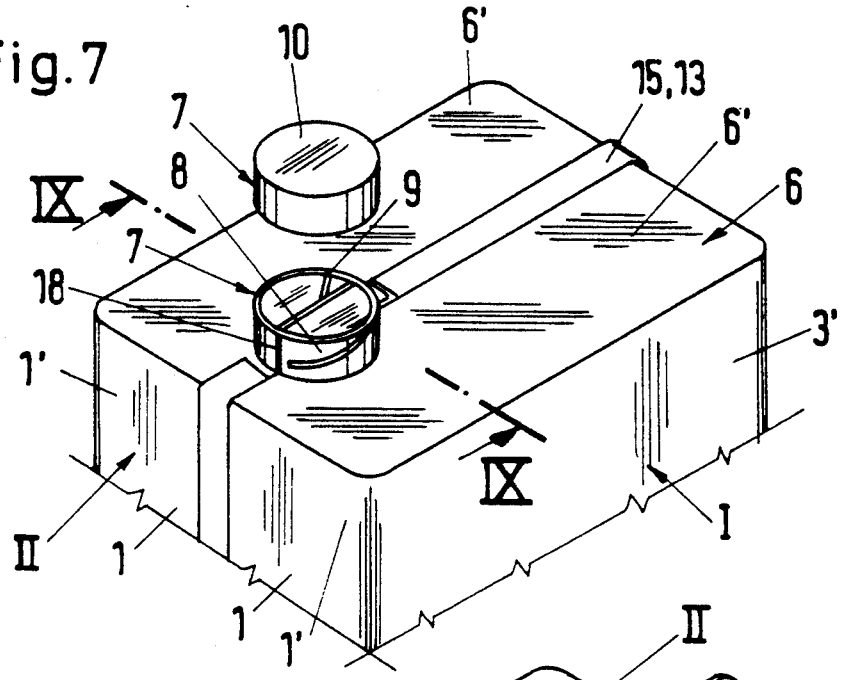
FIG. 7 is a perspective plan view of a differently formed but similar package for containing fluids.
Figure 8:
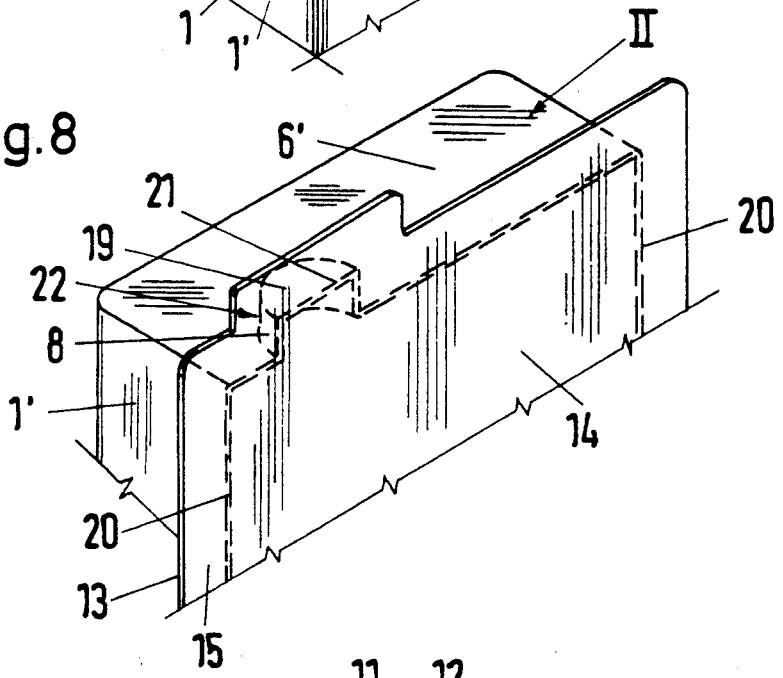
FIG. 8 is a broken away and diagrammatic perspective view of a tub-shaped part viewed from above, with the pourer device.
Figure 8:
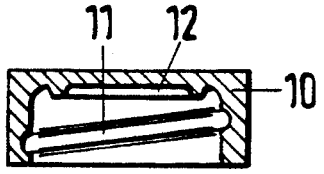

The pourer device 7 consists essentially of a cylindrical rim 8 which is freely connected towards the interior of the package, as shown in FIG. 8, while outwardly and as shown in FIG. 7, it comprises a pourer orifice 9 which, after filling and complete or partial emptying, can be closed by means of a cap 10 which can for example be sealed via a screwthread 11. In the cross-sectional view in FIG. 9, a part of the screwthread 11 can be seen in the interior of the cap 10 and at the top the drawing shows an annular seal 12 by means of which the closure cap 10 is capable of fluid-tightly sealing the pourer orifice 9.

Upon studying the drawings, the viewer will see that the entire package is composed of two tub-shaped parts I and II package to hold fluids and having a capacity of 1 liter, it is possible to accommodate a half a liter of fluid in each tub-shaped part.

The unfilled and open tub-shaped part I or II is not shown here but the viewer and reader may well imagine how each part is provided on its upper outer periphery with a rim 13 which in the view shown in FIG. 8 is represented as an encircling flange-like rim of the same material thickness as the tub-shaped part I or II. A synthetic plastics film 14 encircling rim 13 of the tub-shaped part I or II that it rests flat on the rim 13 of the relevant tub-shaped part I or II in the form of a web 15. Thus, the entire tub-shaped part I or II is sealed in a fluid-tight manner, being in fact welded, because the synthetic plastics film 14 which is for example substantially can be very readily sealed onto the thicker flange-like rim 13 of the tub-shaped part I or II. Thus, by virtue of the bonding of rim 13 and synthetic plastics film 14, a web 15 is produced. After the Joining together stage in FIG. 3 to produce the situation in FIG. 2 and finally the situation which is the completed package shown in FIG. 1, this web 15 is doubled over and is then laid around the surface of the package. In the case of the embodiment described here, the surface in question is the narrow side wall 1, the top 6 and the oppositely disposed narrow side wall 2.

Figure 9:
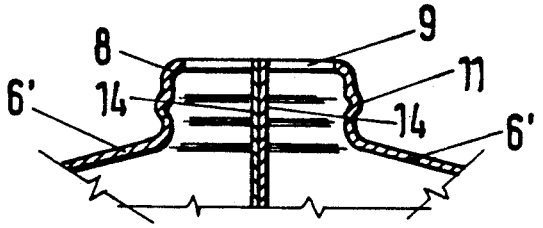
FIG. 9 is a sectional view taken on the line IX—IX in FIG. 7.

While the gripper recesses 16 in the oppositely disposed large side walls 3 and 4 on the one hand and also the recess 17 in the top wall for the more deeply set positioning of the pourer device 7 are of secondary importance to the invention, it is recommended that FIGS. 7 to 9 be especially observed. On a basis of the completed package shown in FIG. 7, although this is an abstracted and different embodiment from that shown in FIG. 1, the viewer will recognise the cut off strip 15 in the region of the pourer device 7 which in particular ends before and after the cylindrical edge 8.

The cylindrical edge 8 itself comprises a welded seam 18 in line with the web 15 of synthetic plastics film 14, because it is composed of two half-ring parts.

Such a half ring for forming the cylindrical edge 8 is shown essentially by broken lines behind the synthetic plastics film 14 and is shown as being closed by a semi-circular plate 19. Thus, FIG. 8 appears to show, represented by a double broken line, the edge 20 of the tub-shaped part II which merges into the U-shaped edge 21 in the region of what will subsequently be the pourer orifice 7. The entire space including that of the semi-cylindrical projection 22 in FIG. 8 and which later will produce the pourer device 7 or the cylindrical edge 8, can be filled with contents and sealed by the synthetic plastics film 14.

In the transition from the situation in FIG. 8 to that in FIG. 9, i.e. to the completion of the package, it is only necessary to remove the semi-circular plate 19 so that the pourer orifice 9 results, being in no way adversely affected, even with regard to its function, by the film 14 which finally traverse the cylindrical rim 8.

Figure 2:
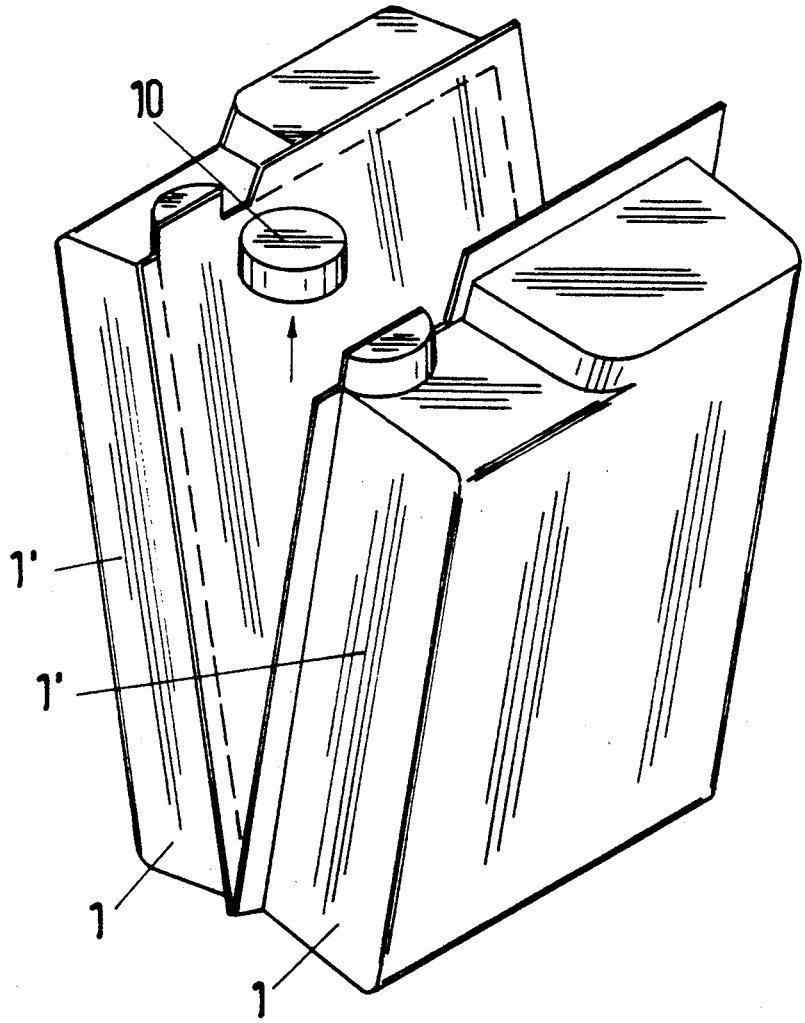
FIG. 2 is a view of the two tub-shaped parts after being sealed with the synthetic plastics film and prior to being joined to each other, the pourer device being towards the viewer.
Figure 3:
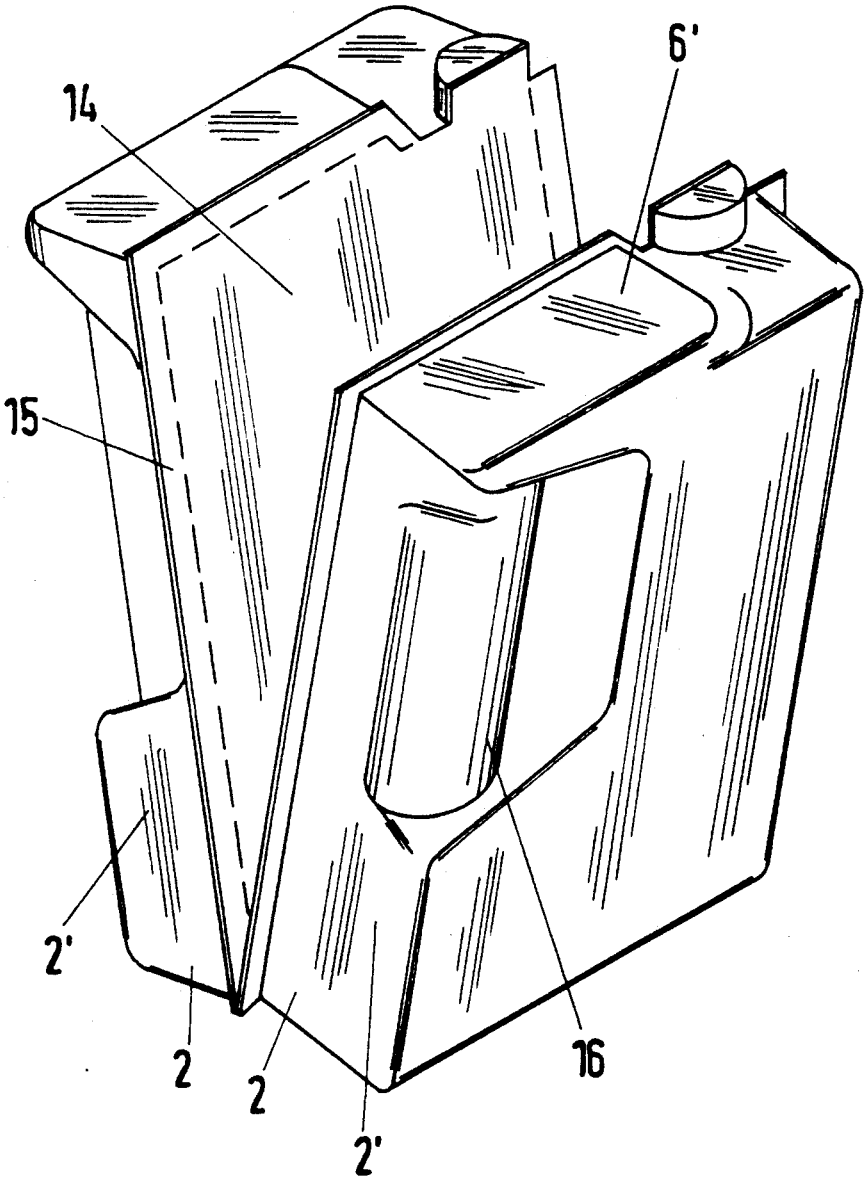
FIG. 3 shows the pourer device remote from the view in a view similar to that in FIG. 2, the two tub-shaped parts being Joined at the bottom in a hinging fashion and being in fact sealed in fluid-tight manner by the synthetic plastics film but as yet not joined to each other.
Figure 4:
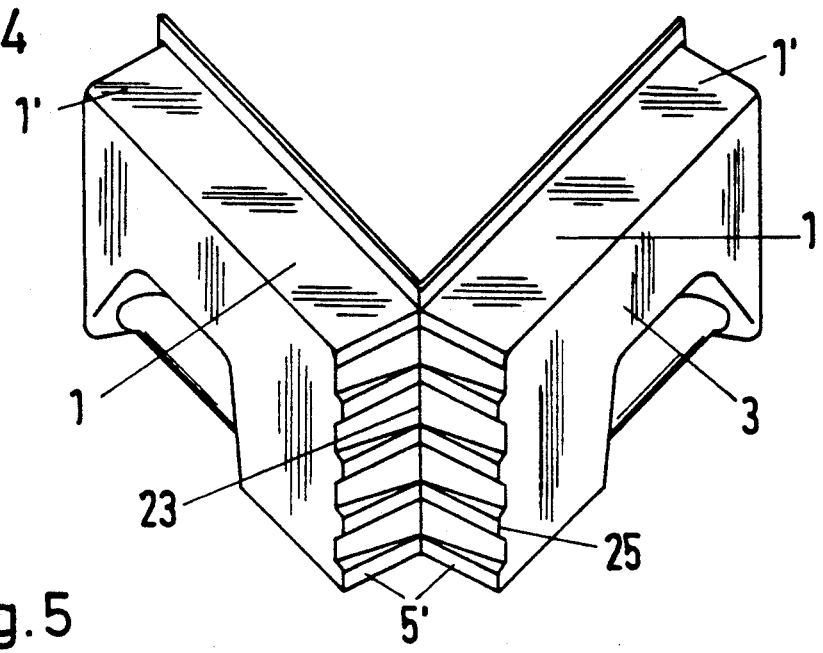
FIG. 4 is a view of the still opened out tub-shaped parts, seen from the bottom and showing the notch-like depressions therein.
Figure 5:
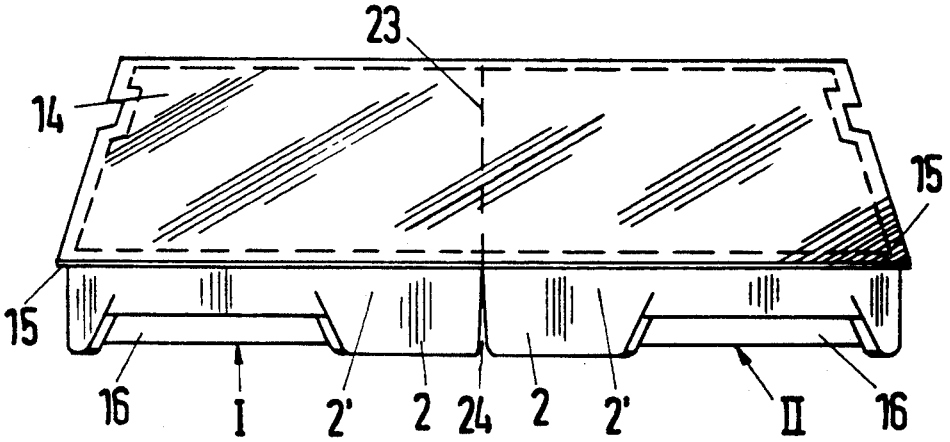
FIG. 5 shows the two tub-shaped parts opened out completely with their film layers in one plane and sealed in fluid-tight manner by the synthetic plastics film.
Figure 6:
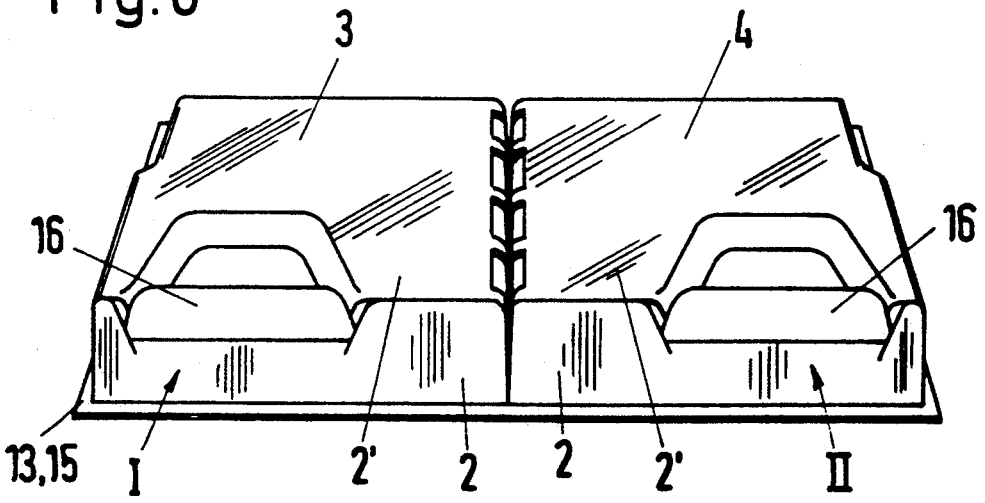
FIG. 6 is a view similar to that in FIG. 5 but from the other, in fact outer side of the package.

It can be seen particularly clearly in FIG. 5 that both tub-shaped parts I and II are masked in a sealing-tight manner by a single synthetic plastics film 14, so that upon the parts being folded together through the situation shown in FIG. 4 to that shown in FIG. 3 and then to that shown in FIG. 2 and finally to the completed package shown in FIG. 1, both parts are articulatingly connected as if by a hinge along the edge 23 of the bottom 5 between the bottom parts 5'. The flat overall configuration is imparted to the bottom 5 only after the two tub-shaped parts I and II have been joined together so that the package has a flat surface on which it can stand. Nevertheless, the bottom 5 docs not actually need to be exclusively flat. Instead, it may in a preferred embodiment comprise notch-like depressions or recesses 25 which extend from the middle edge 23 of the bottom 5 outwardly to the respective end edge 24.

It is particularly favourable if the two tub-shaped parts I and II are connected to each other along the edges 13 and 15 via holes or indentations, because apart from the adhesive action, these also ensure a positive connection between the two tub-shaped parts I, II.

We claim:

1. A package for flowable contents having tube-like side walls (1 to 4), bottom (5) and top wall (6) and with a closable pourer device (7) having a cylindrical edge, all parts (1 to 7) of the package consisting of synthetic plastics material, two tub-shaped parts (I,II), each of which forms an entire side wall (3,4), two oppositely adjacent fractional side walls part (1',2') with peripheral rim portions 13, a fractional bottom part (5') a fractional upper wall part (6') with peripheral rim portion 13 and with a fractional pouring device (7 to 9), each tub-shaped part being connected to one another and individually sealed by means of a synthetic plastics film (14) applied to and projecting beyond the rim (13) in the form of a web (15), and in that the cylindrical edge (8) of the pourer device (7) extends beyond the web (15) of synthetic plastics film (14) to both tub-shaped parts (I,II) and in that the thickness of the synthetic plastics film (14) is 0.01 to 0.5 times the thickness of the rim portions of the tub-shaped parts (I,II), whereby the thickness of the film provides means facilitating the ready passage of heat through the portions of the film applied to the rim portions of the tub-shaped parts, further characterized in that the rim (13) of the tub-shaped part (I,II) and the web (15) of synthetic plastics film (14) which projects beyond the rim (13) while resting thereon engage centrally along the surfaces (1, 6, 2) of the package in essentially a U-shaped pattern from one side wall (1) beyond the top wall (6) to the opposite side wall (2) and centrally, ending in each case folded over onto itself at the edge (24) between side wall (1, 2) and bottom (5).

2. A package according to claim 1, characterized in that the projecting web (15) of synthetic plastics film (14) which rests on the rim (13) of the tub-shaped part (I, II), together with the rim (13), is cut off in the region of the pourer device (7) and is otherwise doubled over and passed along the surfaces (1, 6, 2) of the package.

3. A package according to any one of claims 1 or 2, characterized in that the pourer device (7) is, in comparison with the top wall (6), disposed so that it is lower down in a recess (17).

4. A package according to any one of claims 1 or 2, characterized in that at least two oppositely disposed side walls (3, 4) have a gripper recess (16).

5. A package according to any one of claims 1 or 2, characterized in that the synthetic plastics material of the package is capable of being deep drawn.

6. A package for flowable contents having tube-like side walls (1 to 4), bottom (5) and top wall (6) and with a closable pourer device (7) having a cylindrical edge, all parts (1 to 7) of the package consisting of synthetic plastics material, two tub-shaped parts (I,II), each of which forms an entire side wall (3,4), two oppositely adjacent fractional side wall parts (1',2') with peripheral rim portions 13, a fractional bottom part (5'), a fractional upper wall part (6') with peripheral rim portion 13 and with a fractional pouring device (7 to 9), each tub-shaped part being connected to one another and individually sealed by means of a synthetic plastics film (14) applied to and projecting at least to the rim (13) in the form of a web (15), and in that the cylindrical edge (8) of the pourer device (7) extends beyond the web (15) of synthetic plastics film (14) to both tub-shaped parts (I,II) and in that the thickness of the synthetic plastics film (14) is 0.01 to 0.5 times the thickness of the rim portions of the tub-shaped parts (I,II), characterized in that the bottom (5) comprises recesses (25) which are increasingly deeper outwardly towards the edge (24).

* * * * *